United States Patent [19]

Friedberg et al.

[11] Patent Number: 4,827,273

[45] Date of Patent: May 2, 1989

[54] ANTENNA MOUNTING APPARATUS

[75] Inventors: Milton R. Friedberg, University Heights; Victor W. Trebules, Macedonia, both of Ohio

[73] Assignee: Antenna Incorporated, A Division of Celwave, Cleveland, Ohio

[21] Appl. No.: 21,962

[22] Filed: Mar. 5, 1987

[51] Int. Cl.[4] ..... H01Q 1/32

[52] U.S. Cl. ..... 343/715; 343/888

[58] Field of Search ..... 343/715, 900, 888, 880, 343/882, 711, 713, 702, 905; 174/153 A, 152 A; 248/516

[56] References Cited

U.S. PATENT DOCUMENTS

| | | | |
|---|---|---|---|
| 2,786,884 | 3/1957 | Chadowski et al. | 343/715 |
| 2,946,842 | 7/1960 | Chadowski | 343/715 |
| 3,444,313 | 5/1969 | Goodchild et al. | 343/715 |
| 3,611,402 | 10/1971 | Thomas et al. | 343/900 |
| 3,624,662 | 11/1971 | Feder | 343/715 |
| 3,699,580 | 10/1972 | Joseph et al. | 343/715 |
| 3,944,722 | 3/1976 | Larsen | 343/715 |
| 4,106,024 | 8/1978 | Nijman | 343/715 |
| 4,136,986 | 1/1979 | Grashow et al. | 343/715 |
| 4,170,777 | 10/1979 | Liautaud | 343/715 |
| 4,173,761 | 11/1979 | Liautaud | 343/715 |
| 4,179,698 | 12/1979 | Liautaud | 343/715 |
| 4,184,162 | 1/1980 | Grashow | 343/715 |
| 4,190,839 | 2/1980 | Liautaud | 343/715 |
| 4,198,638 | 4/1980 | Carolus | 343/715 |
| 4,200,874 | 4/1980 | Harada | 343/715 |
| 4,218,684 | 8/1980 | Northcutt | 343/715 |
| 4,223,314 | 9/1980 | Tyrey et al. | 343/715 |
| 4,242,684 | 12/1980 | Wolverton | 343/715 |
| 4,243,989 | 1/1981 | Piper | 343/715 |
| 4,431,332 | 2/1984 | Dieges | 403/252 |

FOREIGN PATENT DOCUMENTS

| | | | |
|---|---|---|---|
| 2726081 | 12/1978 | Fed. Rep. of Germany | 343/715 |
| 2064878 | 6/1981 | United Kingdom | 343/715 |

*Primary Examiner*—William L. Sikes
*Assistant Examiner*—Michael C. Wimer
*Attorney, Agent, or Firm*—Watts, Hoffmann, Fisher & Heinke

[57] ABSTRACT

Antenna mounting structure to mount an elongated communications antenna to a fender. A signal carrying cable is routed from a radio to an opening in the vehicle body. A cable retaining collar slips over the cable and is held in place by an insulating mounting nut. An exposed conductor is then coupled to an antenna base by a metal lock nut that slips over a spherical antenna base. As the lock nut is tightened, the orientation of the antenna is fixed.

9 Claims, 3 Drawing Sheets

ANTENNA MOUNTING APPARATUS

DESCRIPTION

1. Technical Field

The present invention relates to method and apparatus for affixing an antenna to a mounting surface and is particularly suited for mounting an antenna to a vehicle mounting surface such as a vehicle fender.

2. Background Art

A number of different mounting systems for vehicle antennas are known in the prior art. Typically, a hole is drilled in a vehicle fender and a cable couples the fender mounted antenna to a radio mounted in the vehicle dashboard. If the vehicle comes from the manufacturer equipped with a radio, the antenna has been mounted at the factory and all necessary connections between the radio and antenna have been installed.

If, however, the user installs an after market radio and antenna, or moves the location of the antenna on the vehicle, a hole must be drilled in the vehicle, the cable must be routed from the radio to the vicinity of the hole, and the necessary electrical connections between the antenna and the cable must be made. This aftermarket installation is often accomplished by mounting the antenna to the fender and then completing the electrical connection to a cable routed from the radio to a point beneath the fender. This electrical connection step can be difficult, especially in vehicles having limited access to regions beneath the fender where the antenna is mounted.

The problems of interconnecting a radio to a fender-mounted antenna have been exacerbated by the trend towards smaller motor vehicles that have narrow fenders, making access to the region in which the antenna is mounted very difficult. It becomes almost impossible to mount the antenna to the fender and then complete electrical connections between the cable and the antenna from beneath the fender.

DISCLOSURE OF THE INVENTION

Practice of the present invention facilitates the mounting and orientation of an elongated antenna on a mounting surface. In accordance with the invention, an antenna cable is routed through a vehicle fender to a fender well and then through the firewall to the vehicle radio. A connector that is secured to the cable above the fender is used to attach the antenna to the fender. The apparatus of the invention enables the antenna to be securely fastened to a vehicle fender in a correct orientation while ensuring electrical contact between the radio and the antenna. Experience with the connector confirms that it is much easier to route the cable down through the fender to the firewall than to attempt to push the antenna cable up through the fender, especially when the fender is narrow.

In a preferred embodiment of the invention the apparatus includes a cable securing connector for fixing the cable to a support surface so that a free end of the cable is accessible above the exposed surface of the support. Once the cable has been fixed so that a free end is exposed above the surface of the vehicle, an elongated antenna is mounted to the vehicle in contact with the cable's free end. The cable securing connector can accommodate different fender thicknesses.

This antenna preferably includes a mounting base that is spherical and which is forced into engagement with the cable by a locking nut that fits over and engages the spherical antenna base. A conductive end of the cable is pressed against the spherical antenna base as the locking nut is tightened. This assures reliable electrical contact between the antenna and the radio.

In a preferred use, the spherical antenna base is held in a particular orientation by two metallic ring surfaces, one that is connected to the cable positioning connector and a second that is integral with the locking nut. These two ring surfaces bite into the spherical antenna base and fix the antenna in a desired orientation and can accommodate a number of fender configurations.

The antenna can be easily re-oriented and/or replaced by loosening the locking nut and either rotating the antenna (to re-orient the antenna) or completely removing the nut to replace the antenna.

From the above it is appreciated that one object of the invention is an improved antenna mounting mechanism that avoids the necessity of making electrical connections beneath a support surface while allowing the antenna to be easily re-oriented and/or replaced. These and other objects, advantages and features of the invention will become better understood when a detailed description of a preferred embodiment of the invention is described in conjunction with the accompanying drawings.

BEST MODE FOR CARRYING OUT THE INVENTION

Figure 1:
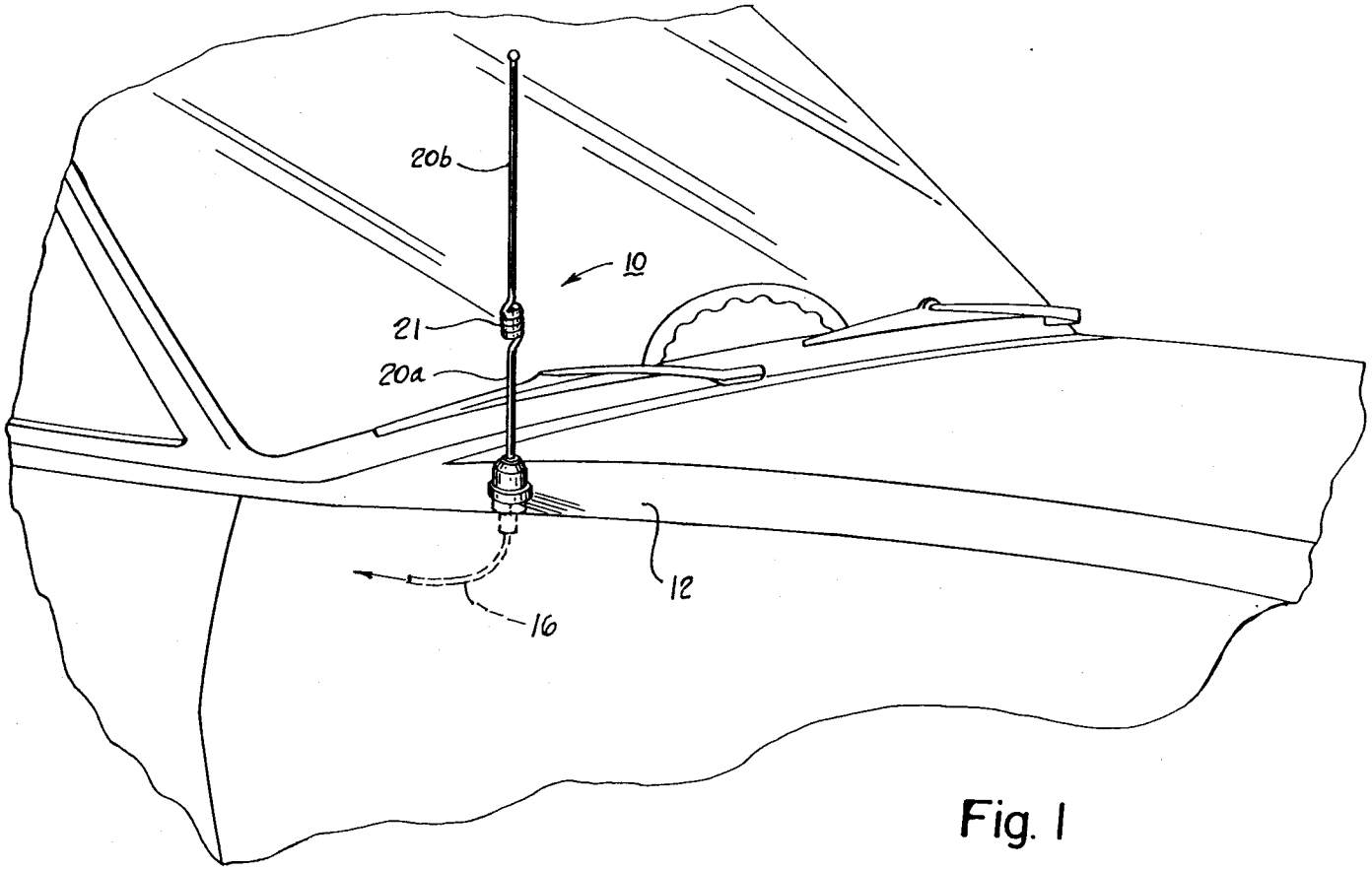
FIG. 1 is a perspective view of a motor vehicle supporting an elongated antenna on its right front on an enlarged scale (×4) fender.

Turning now to the drawings, an elongated antenna 10 (FIG. 1) is shown mounted on a support panel 12 such as a motor vehicle fender. The support panel 12 defines a circular hole or opening 14 (FIG. 3) so that a cable 16 can be routed to a radio (not shown) long a path through the fender opening 14 through the vehicle firewall to the radio.

The sending and receiving portion of the antenna comprises two transceiving sections 20*a*, 20*b* separated by a loading coil 21. A spherical antenna base 22 defines an opening to receive the antenna section 20*a* which is press fit into the opening to secure the antenna to the base. By orienting the base 22 the antenna 10 can be oriented to maximize signal reception and/or signal transmission.

The cable 16 comprises a shielded coaxial cable having a center conductor 30 surrounded by a center insulator 32. A metallic shielding 34 surrounds the center insulator 32 and is covered by an exterior insulator 36.

Approximately one inch of the exterior insulator 36 is stripped away from the cable and the exposed strands 34 of metallic shielding 34 are typically bent back over the end of the remaining insulator 36. A metal eyelet or tube (not shown) fits over the exposed strands and soldered to the strands to assure good electrical contact. A shorter (approx. ¼ inch) portion of the center insulator 32 (FIG. 2) is also stripped away from the center conductor 30.

A metal collar 40 slips over the free end of the communications cable 16 leaving the center conductor 30 and center insulator 32 exposed beyond an end surface 41 of the collar 40. The collar 40 defines a base portion 42 that frictionally engages the cable's outside insulator 36, an intermediate flange portion 44 that contacts an undersurface of the fender when the cable is attached to the fender 12, and a threaded cylindrical end portion 46 that extends above the fender 12 and is separated from the flange by a neck portion 47 that extends through the fender opening 14 with the collar 40 in place.

The collar 40 slips over the exposed end of the cable and an interior surface 42*a* of the collar base portion 42 engages the cable shield 34 and metal eyelet. The collar 40 is then crimped to the cable and also soldered to the eyelet through a hole extending through the collar to the eyelet.

Figure 2:
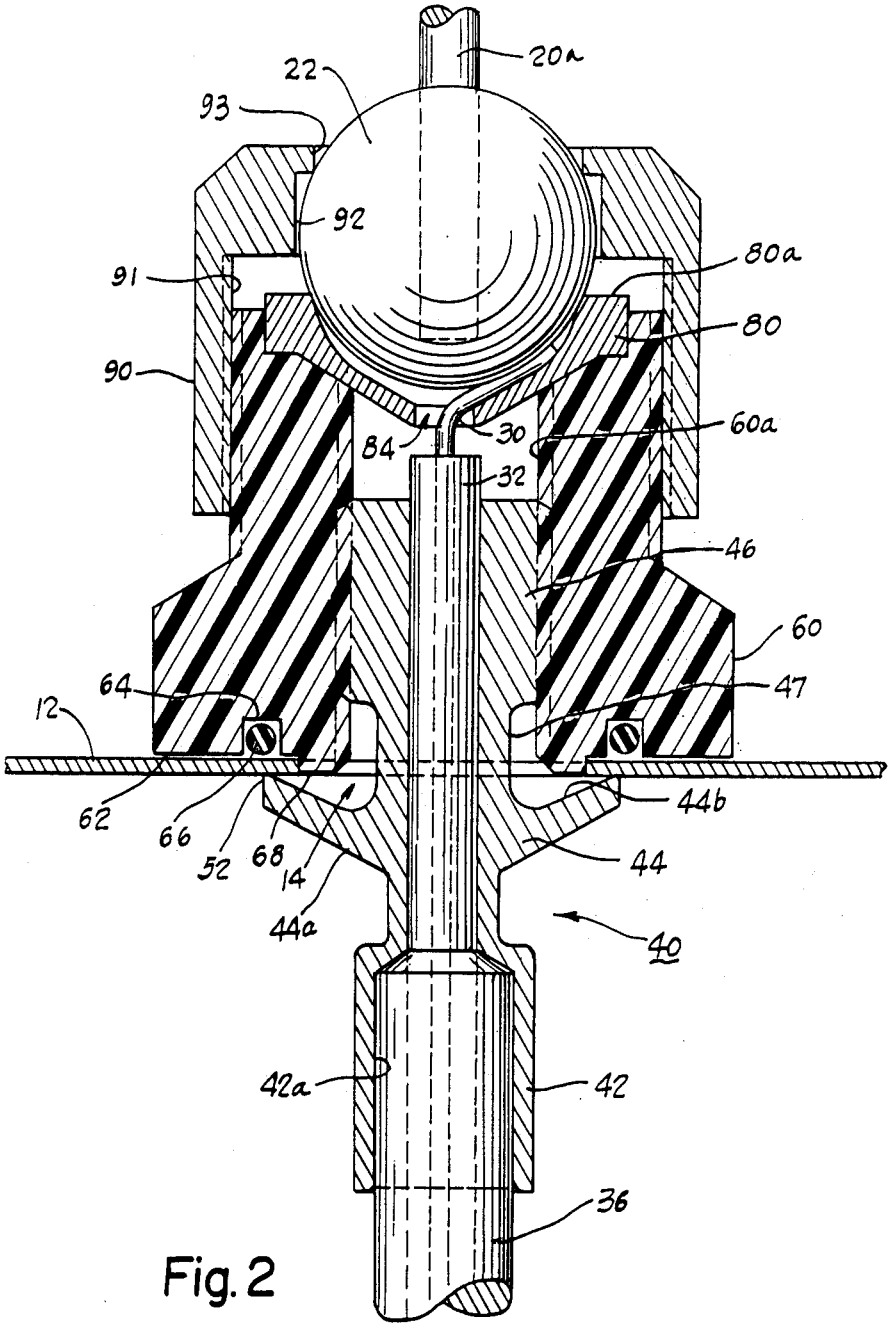
FIG. 2 is a partially sectioned view of an antenna mount constructed in accordance with the invention.
Figure 3:
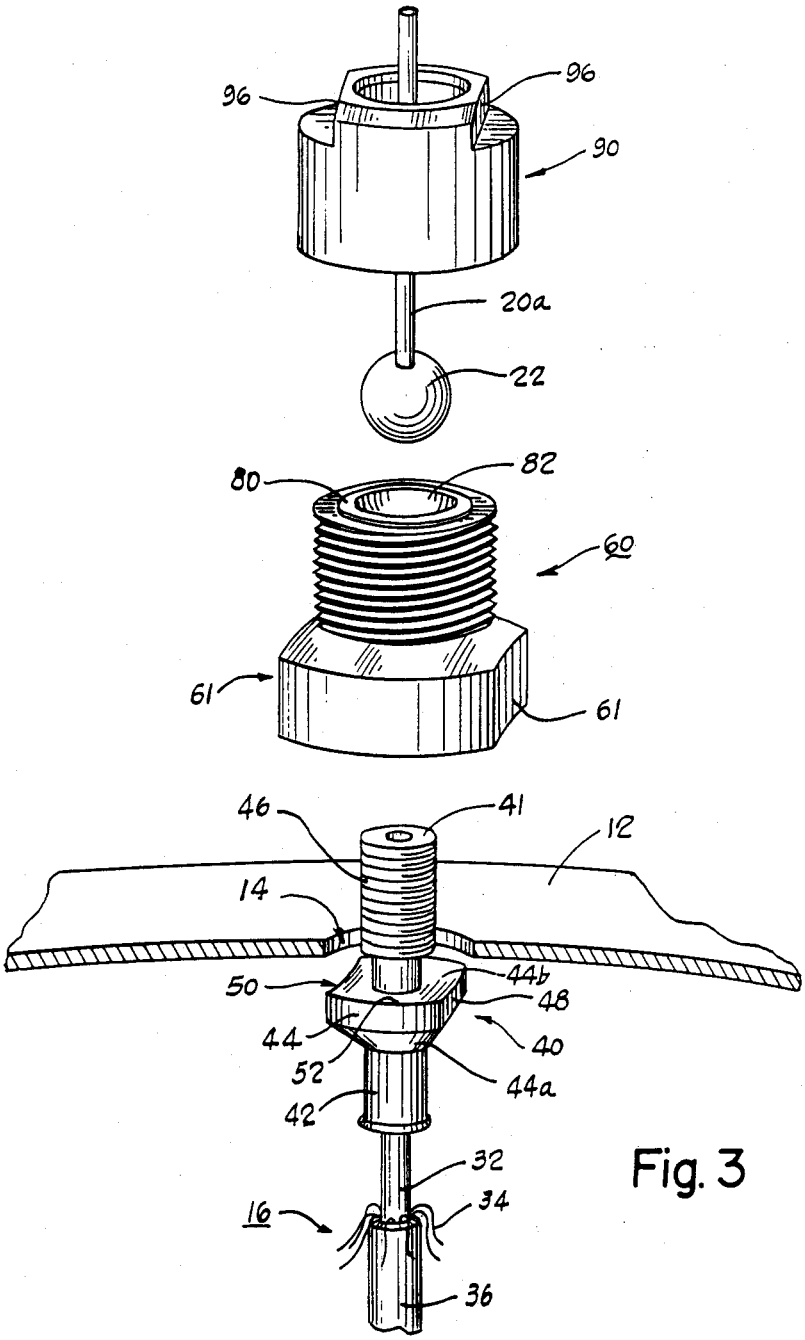
FIG. 3 is an perspective view of components of the FIG. 2 mount showing engagement of those components.

As seen most clearly in FIGS. 2 and 3, the flange portion 44 is cup-shaped having generally convex 44*a* and concave 44*b* surfaces with the concave surface 44*b* facing the vehicle fender. The flange is flattened on opposed sides 48, 50 to allow the collar and attached cable 16 to be toggled through the opening 14. The opening 14 has a diameter greater than the spacing between the two flat collar surfaces 48, 50 but less than the maximum diameter of the flange 44. With the collar 40 fixed to the cable 16 it can be passed through the opening 14 by tilting the collar with respect to the opening and toggling one segment or half of the cup-shaped flange 44 through the opening. The angle of the flange with respect to fender is then adjusted so that the second segment of the flange 44 can also be passed through the opening. The collar 40 is then orientated vertically so that a spaced pair of ridges 52 at the outer edge of the flange 44 contact an underside of the fender 12.

A plastic insulator 60 having a internal threaded opening 60*a* extending the length of the insulator secures the cable 16 to the fender 12. The insulator screws onto the threaded portion 46 of the metal collar 40 and is tightened until an insulator end surface 62 and the collar ridge 52 contact opposite sides of the fender 12. The fact that both the collar 40 and insulator 60 are threaded along extended portions of their outer and inner diameters allows this construction to accommodate different fender thicknesses. A thicker fender only means the insulator 60 will be tightened down a less amount. Passing the collar 40 through the opening 14 from above the fender 12 is preferably accomplished with the insulator 60 threaded a short distance along the threaded collar 46 but may also be accomplished with the insulator separate from the collar 40.

The insulator 60 defines a circular groove 64 (FIG. 2) that faces the fender 12. A flexible elastomeric O-ring 66 fits within the groove 64. When the insulator is tightened down to secure the cable to the fender, the O-ring 66 is slightly compressed to provide a seal that prevents water from seeping through the opening 14 to an underside of the fender 12. The O-ring also functions as a lock nut to prevent rotation of the insulator 60 with respect to the fender. The insulator 60 includes an integrally formed thin circular lip 68 which projects into the opening radially inward from the O-ring 66. The lip 68 functions to locate the insulator 60 in axial alignment with the fender opening 14. In a preferred design the hole or opening 14 has a one-half inch diameter and the lip 68 is therefore slightly less than one-half inch in outside diameter.

The insulator 60 has a depression or cavity at an end of the insulator furthest from the fender to support a metal contact washer 80. In one embodiment of the invention the washer is attached to the insulator 60, preferably by heat sealing or by means of a suitable adhesive that bonds metal to plastic. A concave surface 82 of the washer 80 engages the outer surface of the spherical antenna base 22. The antenna support of the invention could also be accomplished without a washer 80 with the base 22 supported directly by a concave surface of the insulator 60.

As the insulator is tightened the exposed conductor 30 extends up through a washer center opening 84. Flattened side surfaces 61 on the insulator 60 allow the antenna installer to first hand tighten and then use a wrench to complete the task of securing the cable in place. The conductor 30 is then bent at an angle toward the concave surface 82 of the washer 80 and the conductor is ready for electrical connection to the antenna 10.

To complete the antenna mounting, the spherical base 22 is placed into the concave washer surface 82 against the exposed end of the conductor 30. A locking nut 90 is threaded onto an outside threaded surface of the insulator 60. The locking nut 90 defines three different inside surfaces 91, 92, 93 with a first surface 91 threaded to engage the threaded outer portion of the insulator 60. As the locking nut is tightened a second inside surface 92 just clears the spherical base 22 and a third edge surface 93 having the smallest inside diameter of the three surfaces 91, 92, 93 contacts the spherical base 22 to fix the orientation of the antenna.

As the locking nut is tightened, first by hand and then with a wrench that engages flattened sides 96 of the nut 90, the force of the locking nut against the base 22 forces the sphere into tight electrical engagement with the exposed conductor 30. The locking nut 93 and the washer 80 also securely fix the orientation of the spherical base 22.

The locking nut 90 and washer 80 engage the spherical antenna base 22 along two ring-like regions of metal-to-metal contact. The spherical base is preferably constructed of brass and the locking nut 90 and washer 80 are stainless steel. The hard steel of the nut 90 and washer 80 slightly deforms or "bites" into the softer brass and prevents rotation of the spherical base 22. To accommodate the extra pressure exerted on the washer 80 along this ring of metal-to-metal contact, the washer flares outward to form a thicker antenna support portion 80*a* that engages the spherical antenna base 22.

When held in place by the insulator 60 the cable shield 34 is grounded to the metal fender 12 by the collar 40. The locking nut 90 and washer 80 are both connected to the conductor 30 but are insulated from the fender 12 by the insulator 60.

The steps needed to install the antenna are easily accomplished, even with a motor vehicle having limited access to a region beneath the fender. A hole is drilled in the fender and the cable 16 routed through the fender. The cable end 16 has been previously prepared by stripping away the insulating layer 36, bending back the shield wires 34 and stripping away a shorter length of inner insulator 32. The collar 40 has also previously been attached. The collar flange 44 is toggled through the opening and the insulator 60 be tightened down to secure the cable to the fender before the antenna is mounted. Although perhaps difficult, the task of routing the cable to the firewall is much easier than the task of attempting to push the cable up through the vehicle fender well through a hole to the fender's exposed surface.

The present invention has been described with a degree of particularity. It is the intent, however, that the invention include all modifications and alterations of the disclosed design falling within the spirit or scope of the appended claims.

We claim:

1. Apparatus for sending and/or receiving radio communications signals comprising:

cable positioning means for fixing a signal carrying cable to a support panel with an exposed conductor of said cable accessible from above a surface of the panel, said cable positioning means including a collar defining a through passage for routing said signal carrying cable through the panel and having:

(i) a cylindrical base portion defining an inner surface to frictionally engage an outer surface of the cable, (ii) a flanged panel engaging portion truncated on two sides to allow said collar to be routed through an opening in said support panel, and (iii) a cylindrical threaded portion extending above said opening in said support panel;

an elongated antenna having a generally spherical antenna base;

support means to support the antenna base and including an insulating nut having internal threads to engage the cylindrical threaded portion of said collar, a concave metal seat attached to said insulating nut, for said spherical antenna base having a concave contact surface for supporting said spherical antenna base, and an external threaded portion; and locking means engaging said antenna base to maintain the antenna in electrical engagement with said exposed conductor while orienting said antenna base and antenna, said locking means including an antenna retaining nut having inner threaded portions to engage the external threaded portion of the support means to hold the antenna in a fixed position in relation to the panel.

2. An antenna assembly for mounting on a panel having an aperture passing there through; said antenna assembly comprising:

(a) a tubular connector member including a body for projecting through such aperture and having a center bore including an enlarged end portion, the enlarged end portion frictionally engaging external surfaces of an insulated antenna lead, the connector member also including surfaces to engage exposed portions of a ground shield forming a part of such antenna lead;

(b) the tubular connector member including flange structure flaring from the body outwardly and toward such panel when the body is in use, the flange structure including spaced panel engagement surfaces;

(c) a tubular insulator member connected to the connector member in panel clamping relationship, the insulator member including lip structure to maintain the insulator and connector members laterally located with respect to such aperture;

(d) the tubular insulator member including a metal seat functioning as a clamping element at a location remote from such panel when the insulator member is in use;

(e) a tubular locking element for connection to the insulator member;

(f) an antenna base adapted to be clamped between the metal seat and the tubular locking element in an antenna orienting position; and (g) the base and the metal seat including complemental metal surfaces adapted to engage and clamp an exposed conductor of such antenna lead in electrically conductive relationship with said antenna base when the assembly is in use.

3. The assembly of claim 2 wherein the connector and insulator members are threaded to form such member connection.

4. The assembly of claim 2 including gasket means interposed between the insulator member and such panel when the assembly is in use to establish a sealing relationship therebetween.

5. The assembly of claim 2 wherein the locking element is a tubular unit threadedly connected to the insulator member.

6. In combination, an antenna assembly and an apertured panel comprising:

(a) a tubular connector member including a body projecting through the panel aperture and having a center bore which widens at one end portion of the tubular connector member;

(b) an insulated antenna lead, the one end portion of said tubular connector member frictionally engaging external surfaces of the antenna lead, the tubular connector member also including surfaces engaging exposed portions of a shield forming a part of the lead;

(c) the connector member including flange structure flaring from the body outwardly and including spaced panel engagement surfaces, the engagement surfaces being in compressive engagement with the panel;

(d) a tubular insulator member connected to the tubular connector member on the side of the panel opposite the flange structure, the insulator member being in panel clamping relationship maintaining engagement surfaces in such compressive engagement;

(e) the insulator member including lip structure projecting into the aperture and maintaining the insulator member laterally located with respect to the aperture;

(f) the insulator member including a metal seat at a location remove from the panel;

(g) a tubular locking element connected to the insulator member;

(h) an antenna base clamped between the metal seat and the locking element in an antenna orienting position;

(i) the lead including a conductor; and (j) the antenna base and the metal seat including complemental surfaces engaging and clamping the conductor therebetween in electrically conductive relationship.

7. The combination of claim 6 wherein the tubular connector member and tubular insulator member are threaded to form such panel clamping relationship.

8. The combination of claim 6 including gasket means interposed between the insulator member and the panel and establishing a sealing relationship therebetween.

9. The combination of claim 6 wherein the locking element is a tubular unit threadedly connected to the insulator member.

* * * * *